US005716003A

United States Patent [19]

Streetman

[11] Patent Number: 5,716,003

[45] Date of Patent: Feb. 10, 1998

[54] JET PILOT TIP

[76] Inventor: Foy Streetman, P.O. Box 1984, Chickasha, Okla. 73023

[21] Appl. No.: 563,460

[22] Filed: Nov. 28, 1995

[51] Int. Cl.[6] ..... B05B 15/02; F23D 11/38; F23D 14/50

[52] U.S. Cl. ..... 239/115

[58] Field of Search ..... 239/114, 115, 239/116, 117, 123, 589

[56] References Cited

U.S. PATENT DOCUMENTS

| | | | |
|---|---|---|---|
| 576,259 | 2/1897 | Diamond . | |
| 985,505 | 2/1911 | Brinkman . | |
| 1,112,025 | 9/1914 | Nelson | 239/117 |
| 1,839,188 | 12/1931 | Wenderhold | 239/123 |
| 2,347,149 | 4/1944 | Chirgwin . | |
| 3,026,048 | 3/1962 | Gascoigne et al. . | |
| 4,549,525 | 10/1985 | Narang . | |
| 5,025,990 | 6/1991 | Ridenour . | |
| 5,067,657 | 11/1991 | Young et al. . | |
| 5,232,156 | 8/1993 | Csordas et al. | 239/117 |

FOREIGN PATENT DOCUMENTS

| | | | |
|---|---|---|---|
| 3488 | 4/1902 | United Kingdom . | |
| 28776 | 12/1904 | United Kingdom | 239/589 |
| 524719 | 8/1940 | United Kingdom | 239/117 |

*Primary Examiner*—Andres Kashnikow
*Assistant Examiner*—Robin O. Evans
*Attorney, Agent, or Firm*—R. William Graham

[57] ABSTRACT

A jet pilot tip for use in an in-line connection of a fuel supply includes a body having a bore extending therethrough, a threaded surface formed within the bore surface of a first end of the body, an open surface radially extending from the bore surface through to a side of the body, a side conduit member extending the side of the body and communicating with the open surface, the side conduit having means for connecting to the fuel supply, and a cap having a shaft which is of a size and which is complimentary threaded to the threaded bore surface to be threadedly received therein.

7 Claims, 1 Drawing Sheet

JET PILOT TIP

BACKGROUND OF THE INVENTION

1. Field of the Invention

The present invention relates to jet pilot tips. More particularly, but not to be limiting, the invention relates to a jet pilot tip of a configuration which readily allows for cleaning of the tip without disassembly of the jet pilot tip from the line in which it is connected.

2. Related Art

There are numerous jet pilot tips which exist. Typically, common to each is a body having a tapered opening therethrough wherein there exists an inlet at one end of the jet pilot tip of a greater diameter than an outlet at another end of the jet pilot tip. As fuel, such as gas, is moved through the opening from the inlet to the outlet, a jet stream of the gas is produced and introduced into an oxygen environment or mixture and ignited for a particular purpose.

In some applications, particularly in oil field applications, gas bled off of the well head, is used for powering a number of devices or equipment located at the site. The gas usually contains impurities such as sulfides and oxides which over time gum up and block the opening of the jet pilot tip. The only present way to verify the jet pilot tip is free of a blockage, since the jet pilot tip is connected in line, is to shut down the equipment and breakdown the connection adjacent the jet pilot tip to remove the gum or debris from the jet pilot tip. In present field practice, there is no preventive maintenance given. Rather, it is only when the jet pilot tip becomes plugged and, in turn, results in equipment failure is one inspired to break down the system. Meanwhile, damage could have been caused to the equipment. Also, important well operation time is lost which, in turn, costs loss of significant income to the well producer.

There is therefore a need to provide a jet pilot tip which overcomes the disadvantages of the related jet pilot tips. A need for a jet pilot tip which provides means for in-line maintenance and cleaning is desired.

SUMMARY OF THE INVENTION

It is an object to improve jet pilot tips.

It is another object to provide means for easily preventing gumming within a fuel line which employs a jet pilot tip.

Accordingly, the present invention is directed to a jet pilot tip for use in an in-line connection of a fuel supply, which includes a body having a bore surface extending therethrough, a threaded surface formed within the bore surface of a first end of the body, an open surface radially extending from the bore surface through to a side of the body, a side conduit member extending from the side of the body and communicating with the open surface, the side conduit having means for connecting to the fuel supply. Also, included is a cap having a shaft which is of a size and which is complimentary threaded to the threaded bore surface to be threadedly received therein.

In the preferred embodiment, the jet pilot tip includes a body having a tapered bore therethrough such that a first end of the body has an inlet of a predetermined size and a second end of the body has an outlet of a smaller size than the inlet. Within the bore at the first end, there is formed a threaded surface.

A cap has a head which is larger than the inlet and a shaft connected to the head which is complimentary threaded to the threaded bore surface to be threadedly received therein. A seal, preferably a nonflammable o-ring, is disposed about the shaft to seal between the head of the cap and the body to prevent gas or fluid leakage. The body is also formed with an opening radially extending from the bore surface through to a side conduit member which has means for connecting to a gas or fuel supply.

A cleaning pin of slightly less diameter than the size of the outlet is also provided in which to ram through the bore to effect cleaning of the jet pilot tip. In a preferred embodiment, the pin and seal are integrally formed.

Other objects and advantages will be readily apparent to those skilled in the art upon viewing the drawings and reading the detailed description hereafter.

DETAILED DESCRIPTION OF THE DRAWINGS

Figure 1:
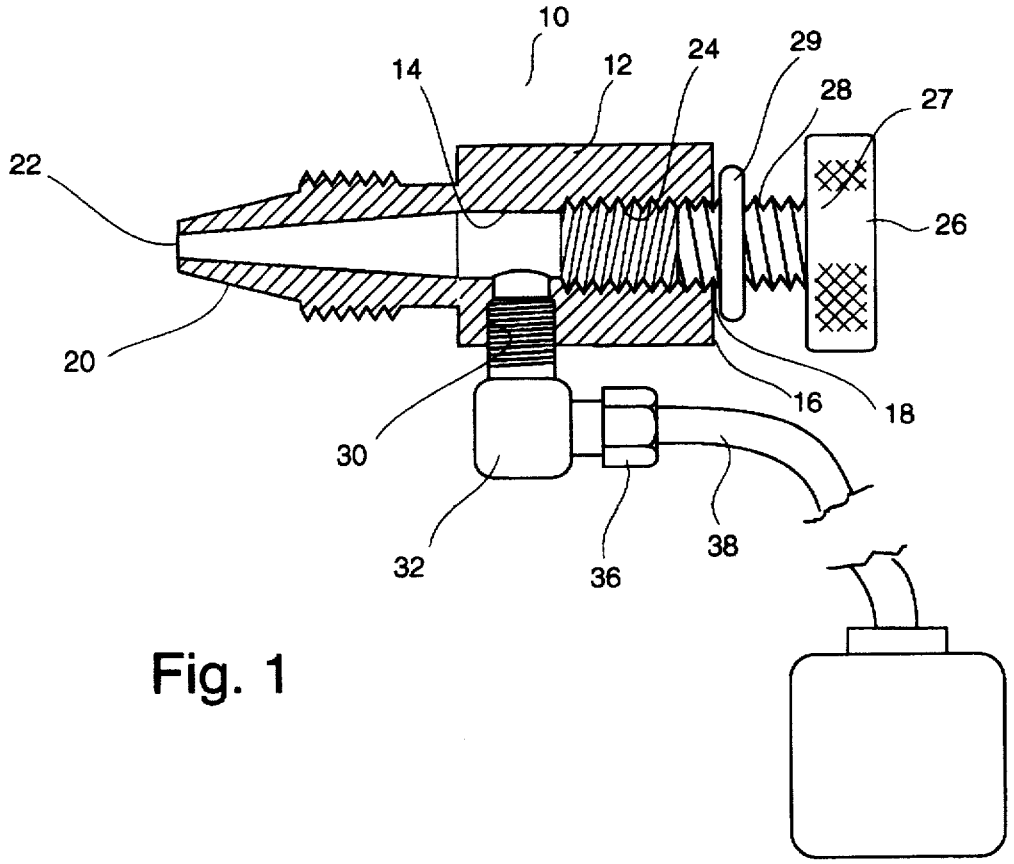
FIG. 1 is a cross section of the jet pilot tip of the present invention.

Referring now to the drawings, a jet pilot tip is generally designated by the number 10. The jet pilot tip includes a body 12 having a tapered bore surface 14 therethrough. A first end 16 of the body 12 has an inlet 18 of a predetermined size and a second end 20 of the body 12 has an outlet 22 of a smaller size than the inlet 18.

Within the bore surface 14 at the first end 16, there is formed a threaded surface 24. A hand threadable cap 26 has a head 27 of a larger size than the inlet 22 and shaft 28 connected to the head 27 which is complimentary threaded to the threaded bore surface 24 to be threadedly received therein. A seal 29, preferably a nonflammable o-ring, is disposed about the shaft 28 to seal between the head 27 of the cap 26 and the body 12 to prevent gas or fluid leakage. The seal 29 may be made of copper, for example.

The body 12 is also formed with an open surface 30 which radially extends from the bore surface 14 through to a side conduit member 32. The conduit member 32 has a passageway surface 34 extending therethrough to the open surface 30 to permit communication therebetween. The side conduit member 32 has means 36 for connecting to a gas or fuel supply 38. The side conduit member 32, while shown as an integrally formed part of the jet pilot tip, could be a standard threaded gas elbow connection wherein the open surface 30 is formed with a threaded aspect to threadedly receive the elbow therein.

The outer configuration of the body can be of any design intended to meet the goals of the invention. Preferably, the second end 20 of body 12 has an outer surface with a threaded aspect to enable connection of the end 20 of jet pilot tip "in-line" with the side conduit member 32 being sufficiently spaced for connection in-line to permit easy removal of the cap 26 and thus access to the bore surface 14.

Figure 2:
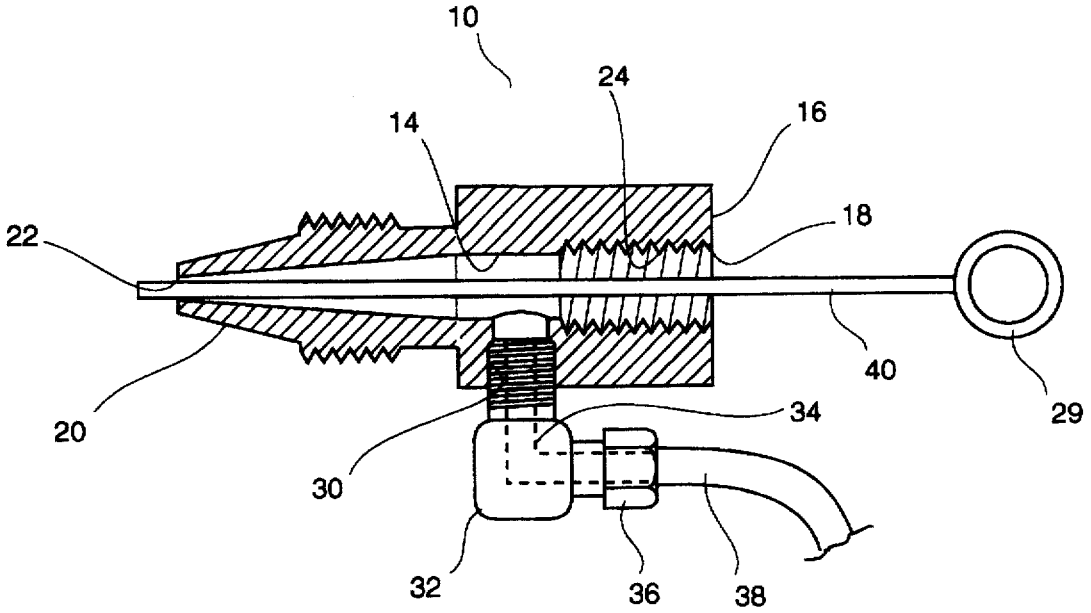
FIG. 2 is a cross section of part of the jet pilot tip shown in FIG. 1 with a cleaning pin disposed therethrough.

In this regard, a cleaning pin 40 of slightly less diameter than the size of the outlet 22 is provided in which to ram through the bore surface 14 to effect cleaning thereof when the cap 26 is removed. This is depicted in FIG. 2.

The above described embodiment is set forth by way of example and is not for the purpose of limiting the present invention. It will be readily apparent to those skilled in the art that obvious modifications and variations can be made to the embodiment without departing from the intent and scope of the invention. Accordingly, the claims appended hereto should be read in their full scope including any such modifications and variations.

What is claimed is:

1. A jet pilot tip for use in an in-line connection of a fuel supply, which includes:

a body having a bore extending therethrough, a threaded surface formed within said bore surface of a first end of said body, an open surface radially extending from said bore surface to a side of said body;

a side conduit member extending from said side of said body and communicating with said open surface, said side conduit having means for connecting to the fuel supply;

a cap having a shaft which is of a size and which is complimentary threaded to the threaded bore surface to be threadably received therein; and a seal disposed about said shaft to seal between said cap and said body to prevent fuel leakage therebetween, a pin removably connectable thereto of slightly less diameter than said bore surface which when said cap is removed can ram through said bore surface to effect cleaning thereof.

2. The threaded jet pilot tip of claim 1, wherein said cap has a head connected to said shaft which is of a larger size that said bore surface.

3. The threaded jet pilot tip of claim 1, wherein said seal is further characterized to be of a nonflammable material.

4. The threaded jet pilot tip of claim 1, wherein said seal and said pin are integrally formed.

5. A jet pilot tip for use in an in-line connection of a fuel supply, which includes:

a body having a tapered bore extending therethrough such that a first end of said body has an inlet of a predetermined size and a second end of said body has an outlet of a smaller size than said inlet, a threaded surface formed within said bore surface of said first end, an open surface radially extending from said bore surface to a side of said body;

a conduit member sealingly extending from said side of said body and communicating with said open surface, said side conduit member having means for connecting to the fuel supply;

a cap having a shaft which is of a size and which is complimentary threaded to the threaded bore surface to be threadably received therein; and a seal disposed about said shaft to seal between said cap and said body to prevent fuel leakage therebetween and having connected thereto a pin of slightly less diameter than said outlet which when said cap is removed can ram through said bore surface to effect cleaning thereof.

6. The threaded jet pilot tip of claim 5, wherein said seal is further characterized to be of a nonflammable material.

7. The threaded jet pilot tip of claim 5, wherein said cap has a head connected to said shaft which is of a larger size that said bore surface.

* * * * *